US008746165B2

(12) United States Patent
Goto

(10) Patent No.: US 8,746,165 B2
(45) Date of Patent: Jun. 10, 2014

(54) COATING DIE AND MANUFACTURING METHOD OF ENAMELED WIRE USING SAME

(75) Inventor: Masayoshi Goto, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 8 days.

(21) Appl. No.: 13/335,992

(22) Filed: Dec. 23, 2011

(65) Prior Publication Data

US 2012/0164315 A1 Jun. 28, 2012

(30) Foreign Application Priority Data

Dec. 24, 2010 (JP) ..... 2010-286975
Dec. 9, 2011 (JP) ..... 2011-270308

(51) Int. Cl.
*B05C 1/04* (2006.01)
*B05C 1/00* (2006.01)

(52) U.S. Cl.
USPC ..... 118/234; 118/209; 118/200

(58) Field of Classification Search
None
See application file for complete search history.

(56) References Cited

U.S. PATENT DOCUMENTS

2003/0173104 A1 * 9/2003 Dell'Anna et al. ..... 174/126.1

FOREIGN PATENT DOCUMENTS

JP 7-1539 1/1995
JP 07-001539 * 1/1995 ..... B05C 3/15

* cited by examiner

*Primary Examiner* — Dah-Wei D Yuan
*Assistant Examiner* — Jethro Pence
(74) *Attorney, Agent, or Firm* — Antonelli, Terry, Stout & Kraus, LLP.

(57) ABSTRACT

There is provided a coating die for applying an insulation varnish around a wire conductor, comprising: a die body; and a die hole formed through the die body, the die hole including: an entry portion having an opening size monotonically decreasing along a conductor insertion direction; and a coating portion comprising a sub-portion having a constant opening size, in which: on an inner surface of the coating portion are provided at least four protrusions equally spaced in a circumferential direction of the inner surface, the protrusions projecting toward a center axis of the die hole; and each of the protrusions includes a portion with a height gradually increasing along the conductor insertion direction from a boundary between the entry portion and the coating portion. There can be formed an enameled wire having a thin and uniform insulation coating by using the invented coating die.

9 Claims, 6 Drawing Sheets

COATING DIE AND MANUFACTURING METHOD OF ENAMELED WIRE USING SAME

CLAIM OF PRIORITY

The present application claims priority from Japanese patent application serial no. 2011-270308 filed on Dec. 9, 2011, which further claims priority from Japanese patent application serial no. 2010-286975 filed on Dec. 24, 2010, the contents of which are hereby incorporated by reference into this application.

BACKGROUND OF THE INVENTION

1. Field of the Invention

The present invention relates to dies for applying insulation enamel coatings to wires (hereinafter referred to as "coating dies"), and particularly to a die for coating wires for use in electrical equipment such as motors and transformers. Furthermore, the invention relates to methods for manufacturing enameled wires using the invented dies.

2. Description of Related Art

Enameled wires (enamel covered insulated wires) are widely used for coil wires in electrical equipment such as motors and transformers. Such enameled wires are formed by covering an insulation coating around a metal conductor having a desired cross section (e.g., circular and rectangular) depending on the application and shape of the coil. With the current trend toward small and high power vehicle motors (e.g., motors for electrical equipment and alternators), there is a requirement to reduce the thickness of insulation enamel coatings for wires so that such wires can be wound into coils at a higher filling factor. Also, there is another requirement for insulation coatings having a uniform thickness because an uneven thickness of insulation coatings can induce insulation breakdown due to concentration of electric fields.

In order to form a thin and uniform insulation coating on a wire, it is extremely important to position (center) the wire to be coated properly with respect to a coating die. Generally, in order to obtain an enameled wire having a coating of a predetermined thickness, an insulation varnish application and baking process is often repeated several times. As a result, an accurate centering procedure also needs to be repeated for a plurality of coating dies, which requires much labor. Meanwhile, whether the centering procedure is accurate or not is typically judged by observing a cross section of the resulting enameled wire after the varnish application and baking process.

One technique to center a wire to be coated with respect to a coating die is to utilize a pressure difference caused by the insulation varnish flow around the wire in the coating die (self-centering force). Since this self-centering force depends largely on various parameters (e.g., a wire feed rate, an insulation varnish viscosity, a gap between the coating die and the wire, a length and an angle of approach portion of the coating die, etc.), coating dies need to be optimally designed for different specifications of enameled wires. Therefore, with this technique, it is difficult to accommodate sudden changes in the specifications of enameled wires.

Meanwhile, JP-U Hei 7 (1995)-1539 A (Japanese Utility Model Application Publication) discloses a die for applying varnish to a core wire, including: a die body; and a die hole formed through the die body, the core wire to be passed through the die hole, in which the die hole has a core wire entry hole portion and successively a varnish restriction hole portion. The die further comprises a guide which aligns the core wire on the center axis of the varnish restriction hole portion. The guide is composed of three or more guide wires, or three or more protrusions provided at predetermined intervals in the circumferential direction on the inner surfaces of the core wire entry hole portion and the varnish restriction hole portion. According to JP-U Hei 7 (1995)-1539 A, since the guide composed of the guide wires or protrusions restricts the core wire passing position in the varnish restriction hole portion so that the core wire always passes along the center axis of the varnish restriction hole portion, the die for applying varnish is capable of applying a uniform varnish coating to the core wire even if the viscosity of the varnish to be applied is low.

However, even an enameled wire having an insulation coating formed by using such a die for applying varnish as disclosed in JP-U Hei 7 (1995)-1539 A can have regions involving an air bubble (air bubble regions) in the insulation coating. If the regions involving an air bubble (air bubble regions) are locally formed in the insulation coating of an enameled wire, an insulation breakdown is prone to occur. In addition, the air bubble regions adversely affect the electrical and mechanical properties of the enameled wire.

Therefore, it is desired that such air bubble regions do not exist in the insulation coating of an enameled wire. The formation of an air bubble region in an insulation coating is attributable to many factors. In many cases, however, a foreign matter such as a baking dross formed during a baking process or a half-peeled flaw remaining on a surface of the wire conductor can be an origin of the air bubble region in the subsequent varnish application process.

Herein, it is believed that half-peeled flaws originate mainly from streak flaws on a wire rod from which wire conductors are formed. Such streak flaws develop during wire rod manufacturing processes. Therefore, subjecting a wire rod to a peeling process is generally effective in reducing half-peeled flaws. However, in the case where cast defects are present in a wire rod, it is technically difficult to remove all the cast defects only by subjecting the wire rod to a peeling process. Also, cast defects that cannot be removed by a peeling process are prone to become exposed on a surface of a wire conductor as they are elongated during a wire drawing process, or they may exist barely covered by a thin layer of the conductor material. In the latter case, bending by a pulley or sliding with a gasket can cause such defects to appear on the surface and the thin layer covering such defects to curl up and become half-peeled flaws.

SUMMARY OF THE INVENTION

In view of the foregoing, it is an objective of the present invention to provide a coating die for forming an insulation enamel coating around a wire conductor such that formation of air bubble regions in the insulation coating is prevented. Furthermore, it is another objective of the invention to provide a method for manufacturing an enameled wire using the invented dies.

(I) According to one aspect of the present invention, there is provided a coating die for applying an insulation enamel varnish around a wire conductor, comprising a die body and a die hole formed through the die body, the wire conductor to be inserted through the die hole. This die hole includes an entry portion and a coating portion. The entry portion has an opening size monotonically decreasing along a conductor insertion direction, and the coating portion comprises a sub-portion having a constant opening size. On an inner surface of the coating portion are provided at least four protrusions equally spaced in a circumferential direction of the inner surface.

These protrusions project toward a center axis of the die hole. Each of the protrusions includes a portion with a height gradually increasing along the conductor insertion direction from a boundary between the entry portion and the coating portion.

In the above aspect (I) of the invention, the following modifications and changes can be made.

(i) Each of the protrusions is formed to have a height gradually decreasing along the conductor insertion direction after reaching peak position thereof.

(ii) Each of the protrusions is formed to have a height being constant after reaching peak position thereof.

(iii) A contour of each of the protrusions is a circular arc, an elongated circular arc, or an elliptical arc in a vertical cross section with respect to the center axis of the die hole.

(iv) A contour of each of the protrusions is a round-cornered quadrilateral in a vertical cross section with respect to the center axis of the die hole.

(v) The maximum height of each of the protrusions is greater than or equal to 0.01 μm and less than or equal to 0.1 μm.

(II) According to another aspect of the present invention, there is provided a manufacturing method of an enameled wire, comprising steps of: inserting a wire conductor through the die hole of the above-described coating die; applying an insulation varnish around the wire conductor in the die hole; and baking the applied insulation varnish.

In the above aspect (II) of the invention, the following modifications and changes can be made.

(vi) The insulation varnish is applied and baked for a plurality of passes, and the coating die is used for at least a first pass of the plurality of passes.

(vii) The coating die is used such that a distance between a surface of the wire conductor inserted through the die hole and an apex of each of the protrusions is greater than 0 μm and less than or equal to 20 μm.

Advantages of the Invention

According to the present invention, it is possible to provide a coating die for forming an insulation enamel coating around a wire conductor such that formation of air bubble regions in the insulation coating is prevented. Also, it is possible to provide a method for manufacturing an enameled wire using the invented dies. Therefore, there can be provided an enameled wire having a thin and uniform insulation coating.

DETAILED DESCRIPTION OF THE PREFERRED EMBODIMENTS

The present inventor has extensively investigated the above-described formation of air bubble regions which occurs in manufacturing an enameled wire using a coating die (during an insulation varnish application and baking process).

Figure 1:
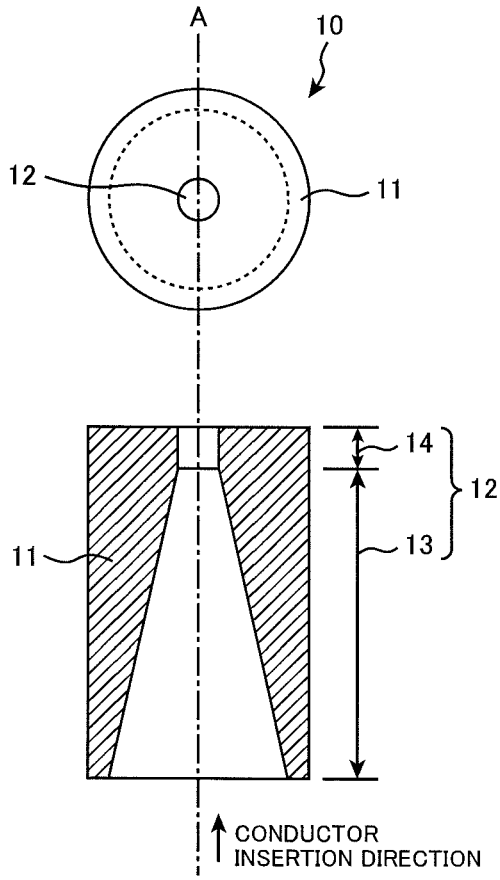
FIG. 1 PRIOR ART
FIG. 1 is schematic illustrations showing a plan view and a cross-sectional view along line A of an example of a conventional coating die.

First, the formation of air bubble regions in an insulation coating formed by using a conventional coating die will be explained. FIG. 1 is schematic illustrations showing a plan view and a cross-sectional view along line A of an example of a conventional coating die. As shown in FIG. 1, a conventional coating die 10 has a die body 11 and a die hole 12 through which a wire conductor is inserted. The die hole 12 is composed of an entry portion 13 having an opening size monotonically decreasing along the conductor insertion direction and a coating portion 14 having a constant opening size.

Figure 2:
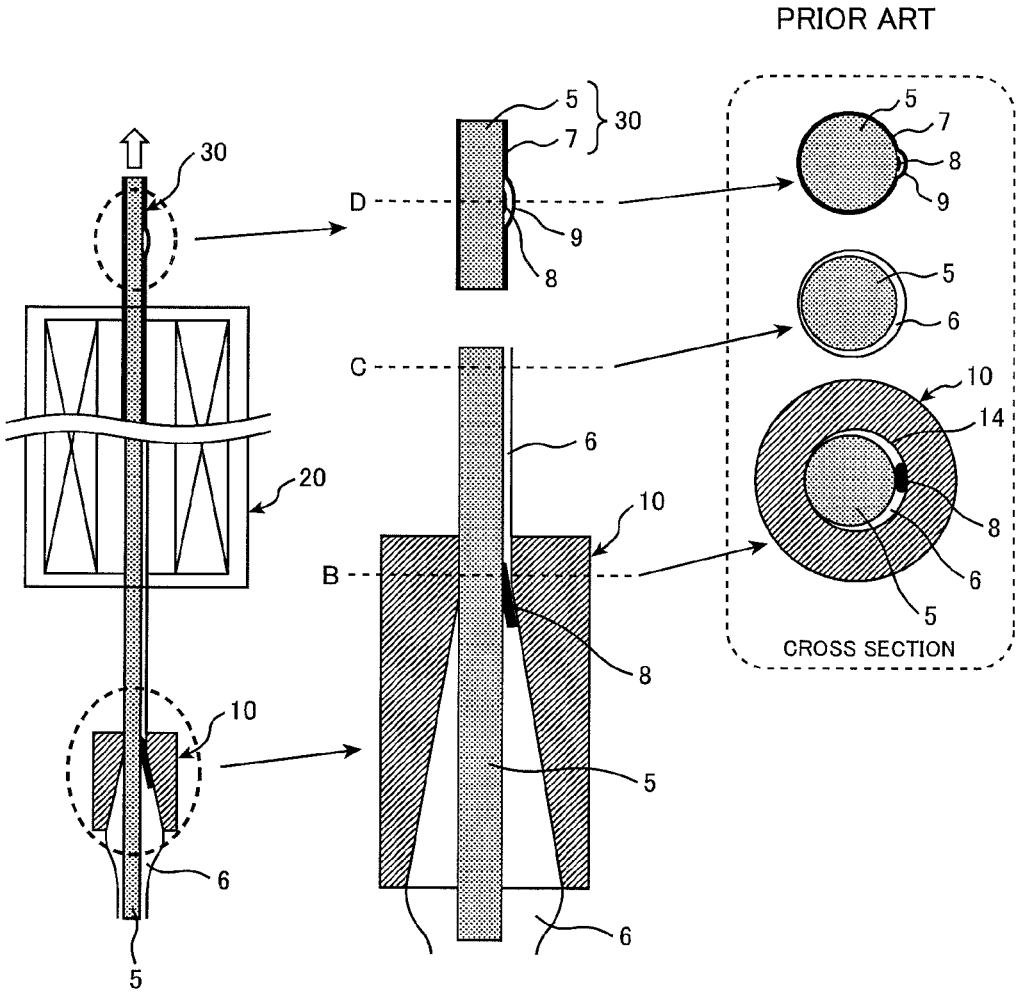
FIG. 2 is schematic illustrations showing a longitudinal cross-sectional view, enlarged longitudinal cross-sectional views of principal portions thereof, and enlarged transverse cross-sectional views of principal portions thereof, in an insulation varnish application and baking process using a conventional coating die.

FIG. 2 is schematic illustrations showing a longitudinal cross-sectional view, enlarged longitudinal cross-sectional views of principal portions thereof, and enlarged transverse cross-sectional views of principal portions thereof, in an insulation varnish application and baking process using a conventional coating die. As shown in FIG. 2, in general, an enameled wire 30 having an insulation coating 7 is manufactured in the following steps: inserting a wire conductor 5 through the coating die 10; applying an insulation varnish 6 around the wire conductor 5; and passing the wire conductor 5 coated with the insulation varnish 6 through a baking furnace 20 to bake it.

During this process, if any foreign matter or half-peeled flaw 8 is present on a surface of the wire conductor 5, the wire conductor 5 becomes off-centered in the coating portion 14 of the coating die 10. This causes partial thickening and thinning of the insulation varnish 6 to occur. At a region thickly coated with the insulation varnish 6, there is a larger diffusion length for gas molecules produced in a cross-linking reaction of the macromolecular component of the insulation varnish 6 to escape. In addition, the foreign matter or half-peeled flaw 8 induces a heterogeneous nucleation, thus working as an air bubble nucleus. As a result, an air bubble region 9 is prone to be formed in such a region.

Figure 3:
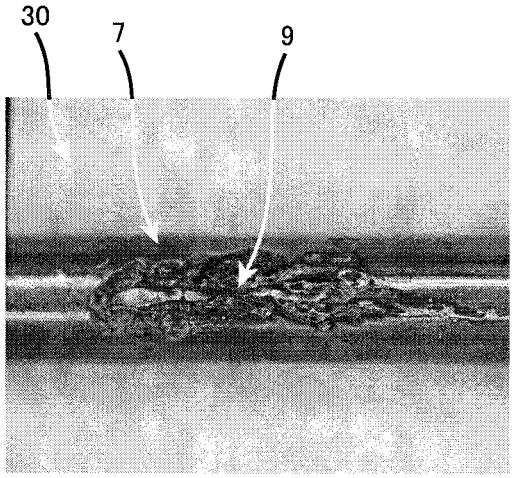
FIG. 3 PRIOR ART
FIG. 3 is a photograph of appearances of an example of an air bubble region formed in the insulation coating of an enameled wire.

FIG. 3 is a photograph of appearances of an example of an air bubble region formed in the insulation coating of an enameled wire. As shown in FIG. 3, the air bubble region 9 formed locally can be observed in the insulation coating 7 of the enameled wire 30.

Meanwhile, at a region thinly coated with the insulation varnish 6, part of the conductor wire can oxidize and turn blue (what is called "bluing"). Such undesirable discolored spots lead to poor appearance and are prone to cause insulation breakdown.

Based on experiments and examinations on the above-described mechanism of the formation of air bubble regions, the present inventor has found out that even when a foreign matter or half-peeled flaw is present on a surface of a wire conductor, the formation of a local air bubble region in the insulation coating on the wire conductor can be suppressed if off-centering of the wire conductor can be suppressed in the coating portion of a coating die by crushing or flattening the foreign matter or half-peeled flaw. At the same time, the inventor has found out that bluing can also be suppressed. The present invention was made based on these findings.

Preferred embodiments of the present invention will be described below. However, the invention is not limited to the specific embodiments described below, and various combinations and modifications are possible without departing from the spirit and scope of the invention. Herein, like reference numerals are used to refer to like items and not again described to avoid repetition.

(Outline Structure of Coating Die)

Figure 4:
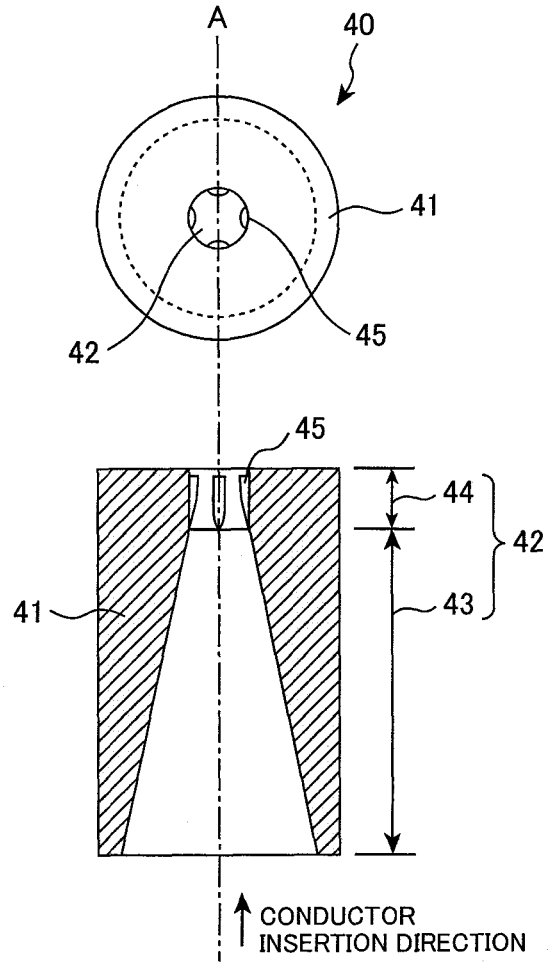
FIG. 4 is schematic illustrations showing a plan view and a cross-sectional view along line A of an example of a coating die according to the present invention.

FIG. 4 is schematic illustrations showing a plan view and a cross-sectional view along line A of an example of a coating die according to the present invention. As shown in FIG. 4, a coating die 40 according to the present invention comprises a die body 41 and a die hole 42 through which a wire conductor is inserted. The die hole 42 is composed of an entry portion 43 having an opening size monotonically decreasing along the conductor insertion direction and a coating portion 44 including at least a sub-portion having a constant opening size. Also, on an inner surface of the coating portion 44 are provided at least four protrusions 45 equally spaced in the circumferential direction of the inner surface, the protrusions 45 projecting toward the center axis of the die hole. In addition, each of the protrusions 45 includes a portion having a height gradually increasing along the conductor insertion direction from a boundary between the entry portion 43 and the coating portion 44. Meanwhile, as is often employed in wire drawing dies, the die body 41 may include, as a peripheral part of the die hole 42, a nib and a nib holder for housing the nib.

Next, each part of the invented coating die will be explained in detail.

(Die Hole)

Figure 5:
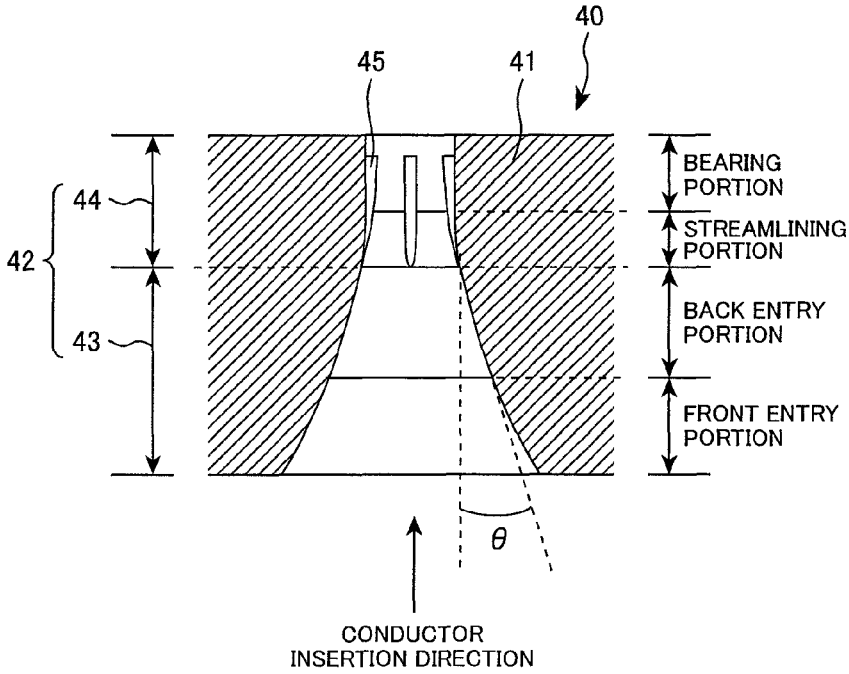
FIG. 5 is a schematic illustration showing an enlarged longitudinal cross-sectional view of a die hole of a coating die according to the present invention.

FIG. 5 is a schematic illustration showing an enlarged longitudinal cross-sectional view of a die hole of a coating die according to the present invention. As shown in FIG. 5, the entry portion 43 has a monotonically decreasing opening size. The entry portion 43 of FIG. 5 has front and back entry portions each having a different average taper angle. However, the entry portion 43 may be configured with only the back entry portion. The back entry portion preferably has an average taper angle θ for example of 10° to 30°. The coating portion 44 has at least a bearing portion having a constant opening size. The coating portion 44 may include, on the conductor inlet side, a front streamlining (laminarizing) portion having a monotonically decreasing opening size and/or, on the conductor outlet side, a back streamlining (laminarizing) portion having a monotonically increasing opening size. Or, the coating portion 44 may be configured with only the bearing portion.

Although, for simplicity of description, the taper angle of the inner surface of the FIG. 5 die hole abruptly changes at each boundary between adjacent die hole portions, the die hole inner surface is preferably formed to have a taper angle that gradually changes at each boundary. Meanwhile, there is no particular limitation on the opening size of the bearing portion, and this opening size is set as appropriate depending on dimensions of the wire conductor and a thickness of the coating to be applied, preferably at 0.50 to 5.0 mm, for example.

(Protrusions)

Figure 6:
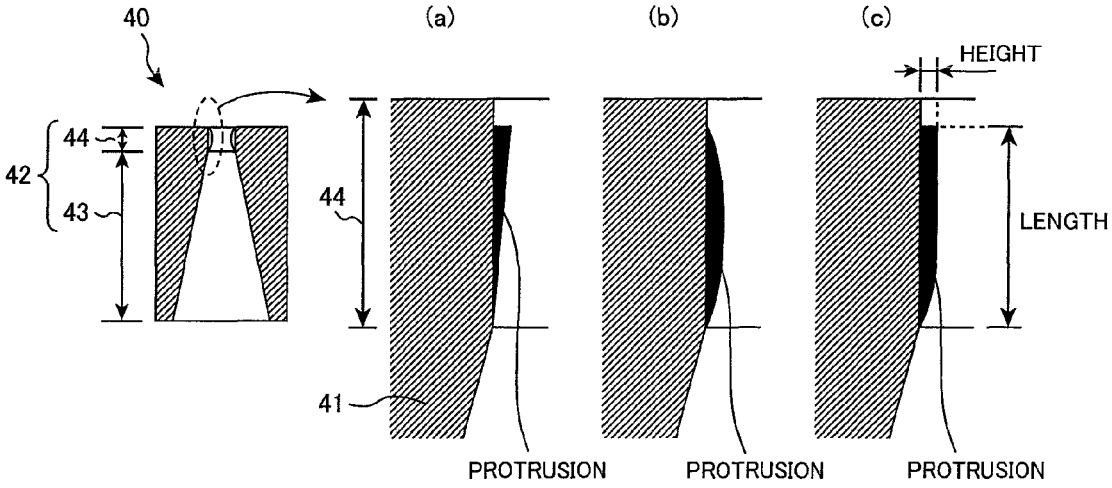
FIGS. 6(*a*)-6(*c*) are schematic illustrations showing enlarged longitudinal cross-sectional views of examples of the coating portion of a coating die according to the present invention.

FIGS. 6(*a*) to 6(*c*) are schematic illustrations showing enlarged longitudinal cross-sectional views of examples of the coating portion of a coating die according to the present invention. As shown in FIGS. 6(*a*)-6(*c*), each of the protrusions 45 provided on the inner surface of the coating portion 44 (the bearing portion, in particular) of the die hole 42 of the coating die 40 is an elongated ridge, which preferably runs parallel to the conductor insertion direction. Each of the protrusions 45 includes a portion having a height gradually increasing along the conductor insertion direction from the boundary between the entry portion 43 and the coating portion 44 so that it can smoothly crush or flatten any foreign matter and half-peeled flaw present on the surface of the wire conductor. This height may monotonically increase over the entire length of the protrusion (see FIG. 6(*a*)), monotonically decrease after it reaches its peak position (see FIG. 6(*b*)), or be constant after it reaches its peak position (see FIG. 6(*c*)).

On the other hand, it is preferable that each protrusion 45 does not extend till the end of the bearing portion (the end on the conductor outlet side). In other words, by providing a portion not having protrusions around the end on the conductor outlet side of the bearing portion, the controllability of a coating thickness of the insulation varnish can be secured. There is no particular limitation on a length of each protrusion 45, and this length is set as appropriate depending on the dimensions of the wire conductor and the thickness of the coating to be applied, preferably at 1 to 2 mm, for example.

Figure 7:
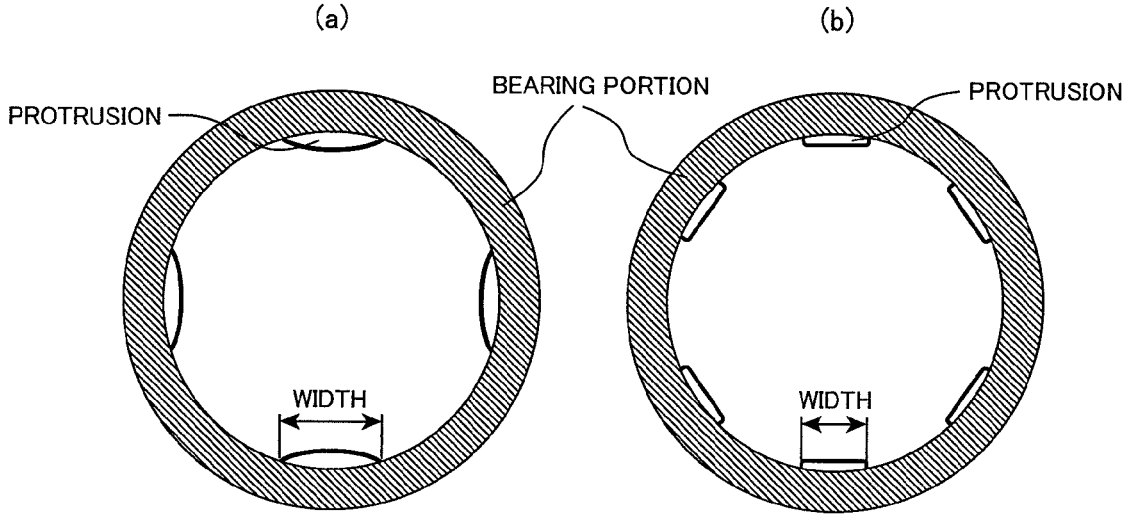
FIGS. 7(*a*)-7(*b*) are schematic illustrations showing enlarged transverse cross-sectional views of examples of a bearing portion (having a constant opening size) of a coating portion of a coating die according to the present invention.

FIGS. 7(*a*) and 7(*b*) are schematic illustrations showing enlarged transverse cross-sectional views of examples of a bearing portion (having a constant opening size) of a coating portion of a coating die according to the present invention. As shown in FIGS. 7(*a*)-7(*b*), at least four (more preferably, six or more) of the protrusions 45 provided on the inner surface of the coating portion 44 (the bearing portion, in particular) of the die hole 42 of the coating die 40 are equally spaced in the circumferential direction of the bearing portion. The top contour of each protrusion 45 may be a circular arc, an elongated circular arc, or an elliptical arc (see FIG. 7(*a*)), or a round-cornered (not sharp-pointed) quadrilateral (see FIG. 7(*b*)) in vertical cross section with respect to the center axis of the die hole 42. Meanwhile, there is no particular limitation on a width of the protrusions 45, and this width is set as appropriate depending on the dimensions of the wire conductor and the thickness of the coating to be applied, preferably at 0.1 to 1 mm, for example.

Figure 8:
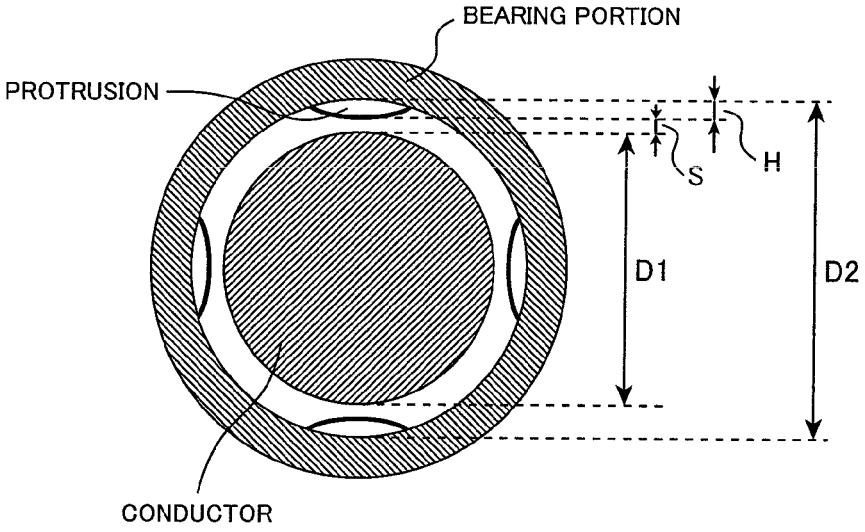
FIG. 8 is a schematic illustration showing an enlarged transverse cross-sectional view of a bearing portion of the coating die of FIG. 7(*a*) with a wire conductor inserted therethrough.

A height of the protrusions is also set as appropriate depending on the dimensions of the wire conductor and the thickness of the coating to be applied, for example, according to the following concept. FIG. 8 is a schematic illustration showing an enlarged transverse cross-sectional view of a bearing portion of the coating die of FIG. 7(*a*) with a wire conductor inserted therethrough. The height H of each protrusion satisfies the following equation (1):

$$H=\{(D2-D1)/2\}-S \qquad \text{Eq. (1),}$$

where, as shown in FIG. 8, D1 denotes the outer diameter of the wire conductor, D2 denotes the inner diameter of the die hole 42 (bearing portion), and S denotes a distance (space) between the surface of the wire conductor inserted through the die hole and an apex of each protrusion (a point where the height of the protrusion reaches its peak).

The space S is preferably greater than 0 μm and less than or equal to 20 μm. "S=0 μm" indicates that the wire conductor and each protrusion are constantly in contact with each other, which can damage the wire conductor and therefore is undesirable. On the other hand, if S is greater than 20 μm, no advantage can be obtained by providing the protrusions.

Also, a distance between the inner surface of the bearing portion and the surface of the wire conductor "(D2−D1)/2" is preferably greater than or equal to 10 μm and less than or equal to 50 μm. Basically, the smaller the distance between the inner surface of the bearing portion and the wire conductor surface is, the less likely an air bubble occurs in the coating. However, if the distance is too small, a coating which can be formed in one varnish application and baking process becomes thin. Therefore, the varnish application and baking process needs to be repeated many times to form an insulation coating having a desired thickness, resulting in an increased manufacturing cost. In other words, suppressing the formation of air bubbles in a coating and controlling the manufacturing cost is in a trade-off relationship. By restricting the value of "(D2−D1)/2" within the above-described range, suppressing the air bubble formation can be balanced against controlling the manufacturing cost.

In view of the above-described "S" and "(D2−D1)/2", the height H of each protrusion is preferably greater than or equal to 0.01 μm and less than or equal to 0.1 μm, and more preferably greater than or equal to 0.02 μm and less than or equal to 0.05 μm. By restricting the value of H within this range, a foreign matter and/or a half-peeled flaw present on the surface of a wire conductor can be effectively and smoothly crushed or flattened toward the wire conductor side as the wire conductor passes through the die hole (the bearing portion).

In addition, the protrusions 45 physically prevent the wire conductor 5 from becoming significantly off-centered, thus effectively reducing thickness variation of the applied coating (i.e., the resultant insulation coating 7). Furthermore, each protrusion 45 works as a streamlining plate for streamlining (laminarizing) a flow of the insulation varnish 6, thus suppressing nonuniform (turbulent) varnish flow and as a result suppressing misalignment between the insulation varnish 6 and the wire conductor 5.

(Manufacturing Method of Enameled Wires)

As described before, an enameled wire is manufactured using a coating device including a plurality of coating dies in the following steps: inserting a wire conductor through a coating die disposed in a coating device; applying an insulation varnish around the wire conductor; and passing the wire conductor coated with the insulation varnish through a baking furnace to bake it. An enameled wire coated with an insulation coating having a desired thickness can be obtained by subjecting a wire conductor to "a process of applying an insulation varnish" and "a process of baking the applied insulation varnish" for each die disposed in the coating device.

In order to crush or flatten foreign matters and/or half-peeled flaws present on the surface of a wire conductor in a stable manner, a coating die according to the present invention is preferably used as the first pass coating die (the first coating die through which a conductor wire is inserted in a coating device).

Meanwhile, besides the above-described foreign matters and/or half-peeled flaws, there may exist linear flaws, which are dents to a minute depth on the surface of a wire conductor along the longitudinal direction. If any further dented spot (pit) is present on these linear flaws, the air contained in such a pit expands by heat during a baking process and emerges as an air bubble on the surface of the insulation coating. Such an air bubble works similar to a half-peeled flaw in an application and baking process for the second and subsequent passes.

More specifically, when a wire conductor with air bubbles arising from linear flaws in the application and baking process for the first pass is subjected to the application and baking process for the second pass, those air bubbles behave like seeds and are prone to attract further air bubbles, resulting in larger air bubbles. Such air bubbles grow larger and larger as the application and baking process is repeated. In view of this phenomenon, another coating die according to the present invention is used to great advantage for the second pass in addition to the above-described first pass coating die in a coating device to effectively remove (crush) air bubbles arising from linear flaws.

In addition, a foreign matter such as baking dross which may be produced during a baking process can become a seed of air bubbles during the application and baking process for the next pass. However, it is difficult to identify a baking process of something as a pass in which a foreign matter such as baking dross would be produced. Therefore, it will be effective in removing (crushing) air bubbles arising from foreign matters such as baking dross if all of the plurality of coating dies disposed in a coating device are in accordance with the present invention.

(Additional Advantages Of The Invention)

Besides the advantages described before, the following advantages can also be obtained according to the embodiments of the present invention:

(1) Since significant off-centering of a wire conductor is physically suppressed by the at least four protrusions provided at equal intervals on the inner surface of the bearing portion in the circumferential direction, the wire conductor can be more readily centered with respect to the coating die, resulting in a reduced manufacturing cost.

(2) In a conventional technique, in order to center a wire conductor with respect to a coating die by using the self-centering force, the viscosity of an insulation varnish needs to be kept low. By contrast, according to the present invention, thickness variation of the applied coating (i.e., the resultant insulation coating) can be reduced even if an insulation varnish having a higher viscosity than in the conventional technique is used. In other words, an insulation varnish with a smaller amount of a solvent component and a volatile component can be used. This contributes to reductions of a material cost and a green house gas emission.

(3) By using an insulation varnish having a higher viscosity than in the conventional technique, the number of times of the application and baking process to be repeated can also be reduced. This contributes to manufacturing cost reduction and energy conservation.

EXAMPLES

The present invention will be more specifically described below by way of examples. However, the invention is not limited to the specific examples below.

Three types of enameled wires (Class 1 polyamide-imide copper wires, 1AIW) were manufactured by using a different kind of coating dies. Each enameled wire had an insulation coating of a designed thickness of 0.039 mm formed around a wire conductor with a diameter of 1.0 mm. The wire conductor used was a copper wire with a diameter of 1.0 mm prepared by subjecting a wire rod (tough pitch copper) with a diameter of 8.0 mm to a wire drawing process without subjecting it to a peeling process. In other words, half-peeled flaws were probably present on the surface of the wire conductor. Meanwhile, the insulation varnish used was a polyamide-imide varnish (a product of Hitachi Chemical Co. Ltd., HI-406-30). The varnish application and baking process was repeated eight times, and the nominal diameters of the die holes (bearing portions) of the coating dies used were 1.080 mm, 1.090 mm, 1.100 mm, 1.110 mm, 1.120 mm, 1.130 mm, 1.140 mm, and 1.150 mm.

The enameled wire of Comparative Example 1 was formed by applying the insulation varnish around the wire conductor using a conventional coating die (see FIG. 1) and baking it. The enameled wire of Example 1 was formed by applying the insulation varnish around the wire conductor using a coating die according to the present invention provided with four protrusions equally spaced on the inner surface of the bearing portion in the circumferential direction (see FIG. 6(*a*) and FIG. 7(*a*)) and baking it. The enameled wire of Example 2 was formed by applying the insulation varnish around the wire conductor using a coating die according to the present invention provided with six protrusions equally spaced on the inner surface of the bearing portion in the circumferential direction (see FIG. 6(*b*) and FIG. 7(*b*)) and baking it. The maximum height of each protrusion was 0.030 mm.

The specimens thus manufactured (Examples 1 and 2 and Comparative Example 1), 10 km long each, were examined visually and by using an outer diameter anomaly detector to see if any air bubble region had been formed on them. If no air bubble region was observed over its entire length of 10 km, the specimen was evaluated as acceptable (Passed); if any air bubble region was observed over its entire length of 10 km, the specimen was evaluated as not acceptable (Failed). The results are shown in Table 1.

TABLE 1

Results of air bubble region formation examination.

| | Example 1 | Example 2 | Comparative Example 1 |
|---|---|---|---|
| Number of Air Bubble Region Formation | 0 | 0 | 14 |
| Evaluation | Passed | Passed | Failed |

As shown in Table 1, no air bubble region formation was observed in the enameled wires of Examples 1 and 2. By contrast, in the enameled wire of Comparative Example 1, 14 air bubble regions were observed. This is attributable to use of the wire conductor on the surface of which half-peeled flaws were probably present.

The results described above demonstrate that by the coating die according to the present invention, an insulation enamel coating can be applied to a wire conductor such that formation of air bubble regions in the insulation coating is prevented. In addition, the manufacturing method of an enameled wire according to the present invention is applicable to both vertical and horizontal coating devices.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A coating die for applying an insulation varnish around a wire conductor, comprising:

a die body; and a die hole formed through the die body, the wire conductor being passed through the die hole, the die hole including:

an entry portion having an opening size monotonically decreasing along a conductor insertion direction; and a coating portion comprising a sub-portion having a constant opening size, wherein:

on an inner surface only within the coating portion are provided at least four protrusions equally spaced in a circumferential direction of the inner surface, the protrusions projecting toward a center axis of the die hole; and each of the protrusions runs parallel to the conductor insertion direction and includes a portion with a height gradually increasing along the conductor insertion direction from a boundary between the entry portion and the coating portion, wherein each of the protrusions does not extend till the end on a conductor outlet side of the coating portion thereby forming a gap between an end of each protrusion and the end of the conductor outlet side of the coating portion.

2. The coating die according to claim 1, wherein each of the protrusions is formed to have a height gradually decreasing along the conductor insertion direction after reaching peak position thereof.

3. The coating die according to claim 1, wherein each of the protrusions is formed to have a height being constant after reaching peak position thereof.

4. The coating die according to claim 1, wherein a contour of each of the protrusions is a circular arc, an elongated circular arc, or an elliptical arc in a vertical cross section with respect to the center axis of the die hole.

5. The coating die according to claim 1, wherein a contour of each of the protrusions is a round-cornered quadrilateral in a vertical cross section with respect to the center axis of the die hole.

6. The coating die according to claim 1, wherein the maximum height of each of the protrusions is greater than or equal to 0.01 μm and less than or equal to 0.1 μm.

7. A manufacturing method of an enameled wire, comprising steps of:

inserting a wire conductor through the die hole of the coating die according to claim 1;

applying an insulation varnish around the wire conductor in the die hole; and baking the applied insulation varnish.

8. The manufacturing method of an enameled wire according to claim 7, wherein the insulation varnish is applied and baked for a plurality of passes, and the coating die is used for at least a first pass of the plurality of passes.

9. The manufacturing method of an enameled wire according to claim 7, wherein the coating die is used such that a distance between a surface of the wire conductor inserted through the die hole and an apex of each of the protrusions is greater than 0 μm and less than or equal to 20 μm.

* * * * *